US008505708B2

(12) United States Patent
Frady et al.

(10) Patent No.: US 8,505,708 B2
(45) Date of Patent: Aug. 13, 2013

(54) ORIENTATION SENSING APPARATUS AND METHOD FOR A BILL VALIDATOR

(75) Inventors: Jamison Frady, Reno, NV (US); Christopher D. Carlisle, Reno, NV (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 13/287,869

(22) Filed: Nov. 2, 2011

(65) Prior Publication Data

US 2013/0081923 A1 Apr. 4, 2013

Related U.S. Application Data

(60) Provisional application No. 61/541,858, filed on Sep. 30, 2011.

(51) Int. Cl.
*G07F 7/04* (2006.01)

(52) U.S. Cl.
USPC ..... 194/206; 194/210; 194/212; 194/213

(58) Field of Classification Search
USPC ..... 194/204–213; 209/534; 702/150–154
See application file for complete search history.

(56) References Cited

U.S. PATENT DOCUMENTS

| | | | | |
|---|---|---|---|---|
| 7,331,520 | B2 * | 2/2008 | Silva et al. | 235/381 |
| 2010/0201955 | A1 * | 8/2010 | Jougo | 353/58 |
| 2011/0126141 | A1 * | 5/2011 | King et al. | 715/769 |

* cited by examiner

*Primary Examiner* — Jeffrey Shapiro
(74) *Attorney, Agent, or Firm* — Foley & Lardner LLP

(57) ABSTRACT

A bill validating apparatus includes a housing having an elongated opening therein. At one end of the elongated opening there is an article receiving slot. A first sensor is on one long side of the elongated slot and a second sensor is on the other long side. The bill validating system includes a transport mechanism for moving the article of tender past the sensors. The bill validating apparatus also includes an orientation determination device communicatively coupled to the first sensor and the second sensor. In response to a determined orientation of the bill validating apparatus, the orientation determination device enables one of the first sensor or the second sensor.

31 Claims, 11 Drawing Sheets

ORIENTATION SENSING APPARATUS AND METHOD FOR A BILL VALIDATOR

TECHNICAL FIELD

Various embodiments described herein relate to an apparatus for sensing the orientation of a bill validator and a method for the same.

BACKGROUND

Many vending machines and other machines use a bill validator to validate bills and transfer a bill into a cash box. Gaming machines also use a bill validator. Gaming machines, and other machines, come in different styles. These different styles of machines include upright machines, slant top machines, and bar top machines. Each of these machines includes a bill acceptor which receives bills and passes them along a substantially horizontal path to a cash box and past a bill validator. In each of these machines, the bill validator has a substantially vertical axis. The assembly in which the bill validators are housed can generally be mounted in two ways and are generally referred to as "downstackers" or "upstackers".

In some applications, such as in a gaming machine, the bill validator also takes tickets which include printed material on one surface. Tickets need to be received in a particular orientation so that, the information on the tickets can be read at a later time. Tickets and cash bills are transported and stacked in a cash box after being validated by the bill validator. From time to time, the cash box is replaced with a new cash box. Autoreaders are used to recount the money and tickets within the cash box after the full cash box has been replaced with an empty cash box. Autoreaders can count the contents of the box, including the tickets if the tickets are all in a particular orientation. Counting of the cash boxes is slowed considerably if the tickets have to be flipped from an unreadable position to a readable position. Flipping tickets during counting wastes time and may involve increased labor for a mundane task.

The tickets generally are only accepted when presented or inserted into the bill validator in one of two ways. One orientation is face up and right and the other is face up and left. This assures that when the tickets are stacked in a bill stacker, they will be of the same orientation for reading. Therefore, the orientation of the bill validator is critical for different types of bill validators associated with different types of cash boxes. The orientation of the bill validator is critical for allowing the tickets to be read, and transported to a stacker in a proper orientation when placed on the stack in a cash drawer.

Bill validators generally have two sets of sensors for detecting currency and bills. One set is on one side of the narrow opening through which bills and tickets are passed and the other set is on the other side of the narrow opening through which the bills are stacked. Currently, if a technician needs to replace a bill stacker, the technician must determine the orientation and then set jumpers or dip switches on the device to enable the proper bank of sensors. On a given casino floor, there may be many different brands and different models of bill validators. Each brand and model of bill stacker may have a different jumper or dip switch setting. Potentially, there may be mounds of user manuals that need to be kept either as a paper copy or as a stored copy that need to be consulted to determine the proper dip switch or jumper settings for a particular model. So, the technician must not only know the orientation but must also determine the settings, such as dip switch or jumper positions, that must be properly positioned to enable the proper sensor or set of sensors to detect tickets and bills. Currently, there is a high probability of error in such systems. When setting a number of dip switches or positioning jumper wires, only one of the many needs to be out of place and the desired sensors will not work. In addition to this, when there are many types of bill validators, the technician needs to carry or have access to the various manuals since the dip switch or jumper settings are different between makes and models of bill validators.

SUMMARY OF THE DESCRIBED EMBODIMENTS

A bill accepting apparatus includes a housing. The housing has an elongated opening therein. At one end of the elongated slot there is an article receiving slot. A first sensor is on one long side of the elongated slot and a second sensor is on the other long side of the elongated slot. The bill validating system includes a transport mechanism for moving the article of tender or a ticket past a first sensor and a second sensor. The bill validating apparatus validates bills and tickets. Most bills are printed on both sides. Unlike a bill, a ticket, many times, includes printing only on one side of the ticket. The ticket is also not translucent or transparent so that it cannot be read from the unprinted surface. After the bill or ticket is validated, the bill or ticket is placed in a stack in a cash box. Cash boxes are removed by operators in a casino environment. Therefore, it is a good idea to protect all concerned by validating what is in the cashbox after a person has handled the cashbox. This verification is done by another machine and the verification process is enhanced or enabled or quickened if the tickets in a stack are all orientated in the same way. For example, all the tickets should be in one orientation in an upstacking cashbox and in one orientation in a downstacking cashbox so the information on multiple tickets that needs to be read can be done so by a reader. If the tickets are all orientated the same way, a machine verification can be done quickly and without a need to stop the process and change the orientation of one or more tickets in a particular stack. In a gaming environment, many times the tickets include financial information so it is in the interest of the casino to settle accounts quickly rather than delay.

The bill validator of the current invention includes an orientation determination device. The orientation determination device determines the orientation of the bill validating device, such as when it is mounted within a machine such as an Electronic Gaming Device (EGM). The orientation determination device is communicatively coupled to the first sensor and the second sensor used to validate a bill (cash denomination) or read and validate a ticket. In response to the determined orientation, the orientation determination device enables one of the first sensor or the second sensor. One sensor can be used to validate bills and tickets in a first orientation such as the "up" position. Many bill validators can validate bills whether up or down. Tickets generally are on thicker stock that cannot be read through so a ticket can only be validated when the printed side of the ticket is passed below the proper sensor. If the ticket is not placed into the slot associated with the bill validator in an "up" position, for example, the ticket is rejected since it cannot be read by the bill validator. The orientation determination device detects gravity using an accelerometer or using a mechanical apparatus so that regardless of how the bill validator is mounted, an "up" orientation can be determined and the proper sensor for reading tickets and various cash denominations is enabled.

The orientation determination device can be placed on an external surface of the housing or within the housing. The orientation determination device, in one embodiment, is communicatively coupled to a processor associated with the bill validator. The processor sets up components within the bill validator in response to the determined orientation. For one orientation the settings on a component will be set to a first value and for another component the settings on a component will be set to a second value. In some bill validators, duplicate components are provided. For one determined orientation, one of the duplicate components is selected, and for another orientation the other duplicate components are selected. For example, a bill validator may have a bank of reading elements on one side of a bill or ticket and may also include another bank of reading elements on the other side of a bill or ticket.

A method for operating a bill validator includes determining orientation of a bill validator using a sensor, obtaining an indication of orientation of the bill validator from the sensor, and enabling components of the bill validator in a first manner in response to indication of a first orientation, and enabling components of the bill validator in a second manner in response to indication of a second orientation. Determining orientation includes the sensor producing a first signal for the first orientation and producing a second signal for the second orientation. In another embodiment, determining orientation includes the sensor producing a first signal for the first orientation and producing no signal for the second orientation. The method also includes executing a set of instructions related to determining orientation when a detected gravitational force is not near a particular axis. The set of instructions includes a set of rules with respect to angular displacement of a gravitational force from an axis of the bill validator.

A method for placing a bill validator apparatus in an environment includes providing mounts to allow mounting of the bill validator in a plurality of orientations, and mounting the bill validator in the environment using at least some of the mounts. The method also includes detecting orientation with a sensing element associated with the bill validator, indicating an orientation of the bill validator after mounting the bill validator in the environment, enabling at least one component when the sensing element indicates a first orientation, and enabling at least one other component when the sensing elements indicates a second orientation of the bill validator.

BRIEF DESCRIPTION OF THE DRAWINGS

The embodiments will be readily understood by the following detailed description in conjunction with the accompanying drawings, wherein like reference numerals designate like structural elements, and in which.

DETAILED DESCRIPTION

In the following paper, numerous specific details are set forth to provide a thorough understanding of the concepts underlying the described embodiments. It will be apparent, however, to one skilled in the art that the described embodiments may be practiced without some or all of these specific details. In other instances, well known process steps have not been described in detail in order to avoid unnecessarily obscuring the underlying concepts.

Figure 1:
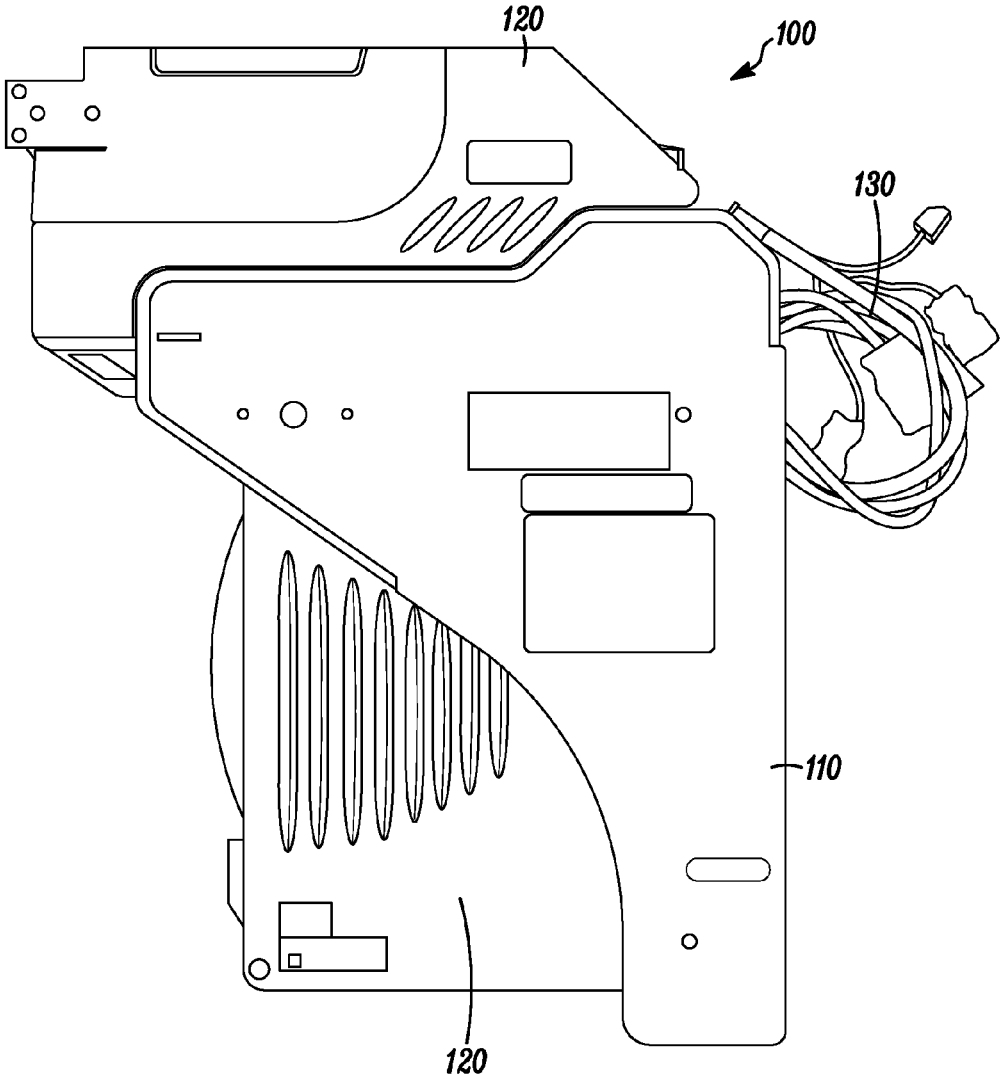
FIG. 1 is a side view of a bill acceptor apparatus, according to an embodiment of the invention.

FIG. 1 is a side view of a bill acceptor apparatus 100, according to an example embodiment of the invention. The bill acceptor apparatus 100 includes chassis 110, a cash box 120, and a bill validator 200. The bill validator 200 and the cash box 120 are attached to the chassis 110. The bill acceptor also includes a set of electrical connections 130 between the cash box 120 and the bill validator 200. The bill validator 200 communicates with the cash box 120. The bill validator 200 also includes an orientation determination device 210 (shown in FIG. 2). The orientation detection device 210 is located within the bill validator 200 in the embodiment shown. It should be noted that the orientation detection device 210 can also be located on the exterior of the bill validator 200. In some embodiments, the orientation detection device 210 can also be located remote from the bill validator 200. For example, the orientation detection device 210 could be physically attached to the chassis 110 or to the cash box 120 in some embodiments.

Figure 2:
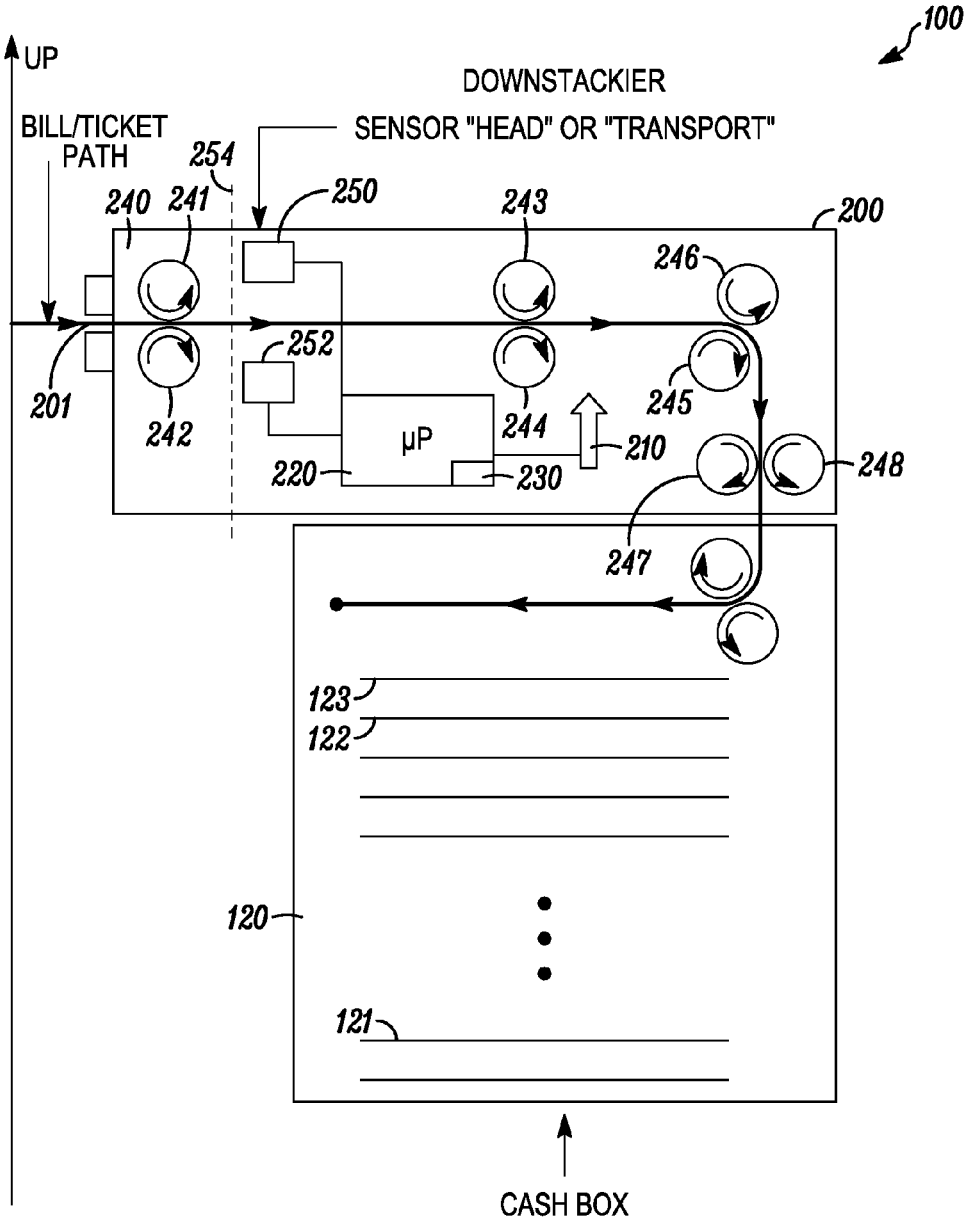
FIG. 2 shows a schematic diagram of a bill acceptor, according to an example embodiment.

FIG. 2 shows a schematic diagram of a bill acceptor 100, according to an example embodiment. The bill acceptor 100 shown in FIG. 2 is a downstacker type bill acceptor 100. The bill validator 200 includes the orientation detection device 210 as well as a microprocessor 220 and memory 230. The bill validator 200 also includes a transport mechanism 240 and a first sensor 250 and a second sensor 252. The first sensor 250 and the second sensor 252 are communicatively coupled to the microprocessor 220 and the associated memory 230. Of course, the memory 230 can be random access memory ("RAM"), or another type of memory or a combination of RAM and another type of memory. The sensors 250 and 252 actually do the reading and sensing to validate a bill or ticket. An axis 254, depicted by an dashed line, for the bill validator 200 passes through or alongside the first sensor 250 and the second sensor 252.

The transport mechanism 240 can include one or more rollers adapted to move an item past the sensors 250 and 252 where the item being transported is either validated and transported to the cash box 120, or rejected and backed out of the bill validator 200 through a slot 201 at a front face 202 of the bill validator 200. The bill validator 200 includes a bill or ticket path 260 along which a bill or ticket is transported through the bill validator 200 and to the cash box. In some environments, the bill validator 200 not only reads information to validate that the item being transported is cash currency, but also validates information printed on a ticket. A ticket or paper currency is placed in the slot 201, and transported along the currency or ticket path 260 by means of rollers 241, 242, 243, 244, 245, 246, 247, 248 associated with the transport mechanism 240. It should be noted that the bill transport mechanism 240 not only includes the ability to move currency or a ticket in the direction of the bill or ticket path 260 (as depicted by the arrows in FIG. 2), but also in a reverse direction if a bill or ticket is rejected, and transverse to the bill or ticket path 260 in the event a bill or ticket needs repositioning. The transport mechanism 240 transports the bill or ticket to be validated past a first sensor or reader 250, and past a second sensor or reader 252. One of the sensors or readers 250, 252 is enabled to read the items transported along the bill or ticket path 260. In some embodiments, a sensor 250, 252 can read and validate a bill regardless of which side of the bill is facing the sensor 250, 252. Tickets, however, generally are printed only on one side or only carry the needed information on one side of the ticket. To validate and read a ticket or the information on the ticket, the side with the information to be read must be presented to one of the sensors 250, 252. Tickets are generally printed to paper stock that cannot be read from a side other than the side on which the information needed is printed. As a result, at least the tickets must be placed on the paper path in a proper orientation so that the tickets can be read.

The orientation detection device 210 determines the orientation of the bill validator 200. In one embodiment, the ticket orientation is with the printed information "up". In some embodiments, the ticket must also be orientated as positioned at or near the side of the paper path 260 or at the side of the slot 201. In these embodiments, the ticket items must be placed in the slot either "up and to the right edge" or "up and to the left edge". The orientation detection device 210 determines which way is up. Put another way, the orientation detection device 210 determines which of the sensors or readers 250, 252 is above the other of the sensors or readers 252, 250 in the current orientation. The sensor or reader 250 or 252, that is above a bill or ticket transport path 260 is enabled. Again, put another way, the sensor or reader 250 or 252 that is highest is enabled, while the other sensor or reader 252 or 250 is disabled or not enabled. The orientation detection device 210, in one embodiment, is an accelerometer that detects the force of gravity. Once the vector associated with the force of gravity is determined, the up position or orientation can be determined. Up will be opposite the force of gravity. The position of the sensors or readers 250, 252 relative to one another can also be determined once the direction of gravity is determined. In another embodiment, an electromechanical orientation detection device can be used. In this embodiment, an elongated member that is electrically conductive is placed on a pivot. Two additional pins bracket the free end of the elongated member. If the bill validator 200 is positioned one way (with sensor 250 above sensor 252), the elongated member will contact one pin, and if the bill validator 200 is positioned another way (with sensor 252 above sensor 250), the elongated member will contact the other pin. Based on the determined orientation, one of the sensors 250 or 252 will be enabled. For example, if orientated as shown in FIG. 2, the sensor 250 will be enabled if the required orientation for the tickets is "up". In another embodiment, the ticket's proper orientation could be with the printing "down" and then the sensor 252 would be enabled.

Figure 11:
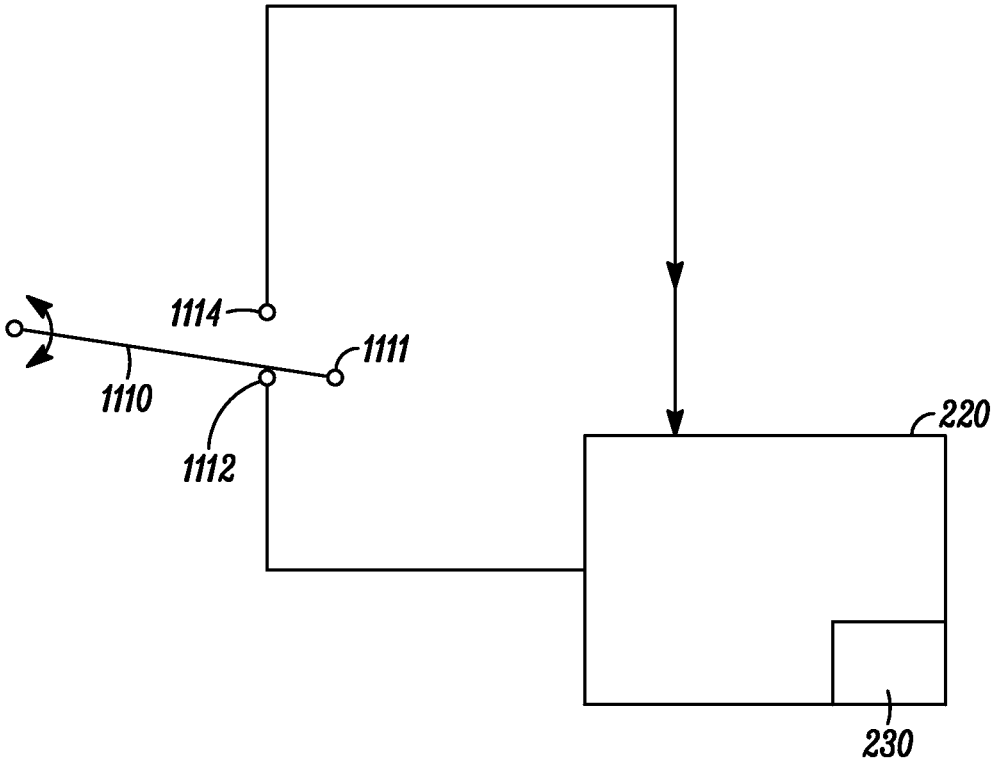
FIG. 11 is a schematic view of a mechanical orientation determination device, according to an example embodiment.

FIG. 11 is a schematic showing a mechanical device 1100 which is used to detect orientation, according to an example embodiment. The mechanical device 1100 includes a long member 1110 that is pivotally attached to a surface. The long member 1110 is electrically conductive. A second electrically conductive member 1112, and a third electrically conductive member 1114 bracket the end of the long member 1110 so that when the long member 1110 is placed in a particular orientation along one axis or at certain angular displacements from the axis, the long member 1110 will not contact the second 1112 and third 1114 electrically conductive members. When the device 1100 is placed in another orientation, the long electrically conductive member pivots and the free end 1111 completes an electrical circuit with one of the second 1112 or third 1114 electrically conductive members. In other words, the free end 1111 of the long electrically conductive member 1110 is positioned between the two electrically conductive members when the bill validating apparatus is in a first orientation, and the free end 1111 of the long electrically conductive member 1110 is positioned in an electrically conductive position when the bill validating apparatus is in a second orientation. In another embodiment, the mechanical device 1100 can be placed so that the second conductive member 1112 and the third conductive member 1114 are parallel to the vertical axis 254 of the bill acceptor or bill validator 200. When the bill validator is in a first orientation, the elongated member 1110 will complete a circuit with the third conductor 1114 and produce a signal which is output to the microprocessor or microcontroller 220. When the bill validator is in a second orientation, the elongated member 1110 will complete a circuit with the second conductor 1112 and produce another signal which is output to the microprocessor or microcontroller 220.

In another embodiment, the orientation determination device 210 is an accelerometer, such as part number KXSS5-2057 available as from Kionix of Ithaca, N.Y., USA. This is just one example of an accelerometer. Others may be available and could be readily substituted for the example part provided above.

Advantageously, the orientation of the bill validator can be determined as soon as it is installed and the correct sensor or reader can be enabled automatically. There is no need for a technician to determine the orientation and set jumpers or dip switches to enable the appropriate reader or sensor. This saves time as the technician no longer needs to know the dip switch or jumper setting positions for various models. Technicians or installers make fewer mistakes since the orientation is determined. The orientation detection device 210 sends a signal indicating the orientation is sent to the microcontroller or microprocessor 220. Based on the signal received, the microprocessor 220 enables the correct sensor 250, 252 so that a properly oriented ticket can be read.

Tickets or bills placed on the bill or ticket path 260 are tested for validation by the enabled sensor, such as sensor 250 in FIG. 2, when the ticket is placed onto the bill or ticket path 260 with the printing or required information facing up at the slot 201. Validation takes place if the ticket or bill is valid. If valid, the transport mechanism 240 moves the ticket or bill to the cash box 120. As shown in FIG. 2, a bill 121, a ticket 122, and a bill 123 and other bills and tickets are positioned in the cash box 120. This particular orientation of the bill acceptor 100 is referred to as a downstacker type bill acceptor.

Figure 3:
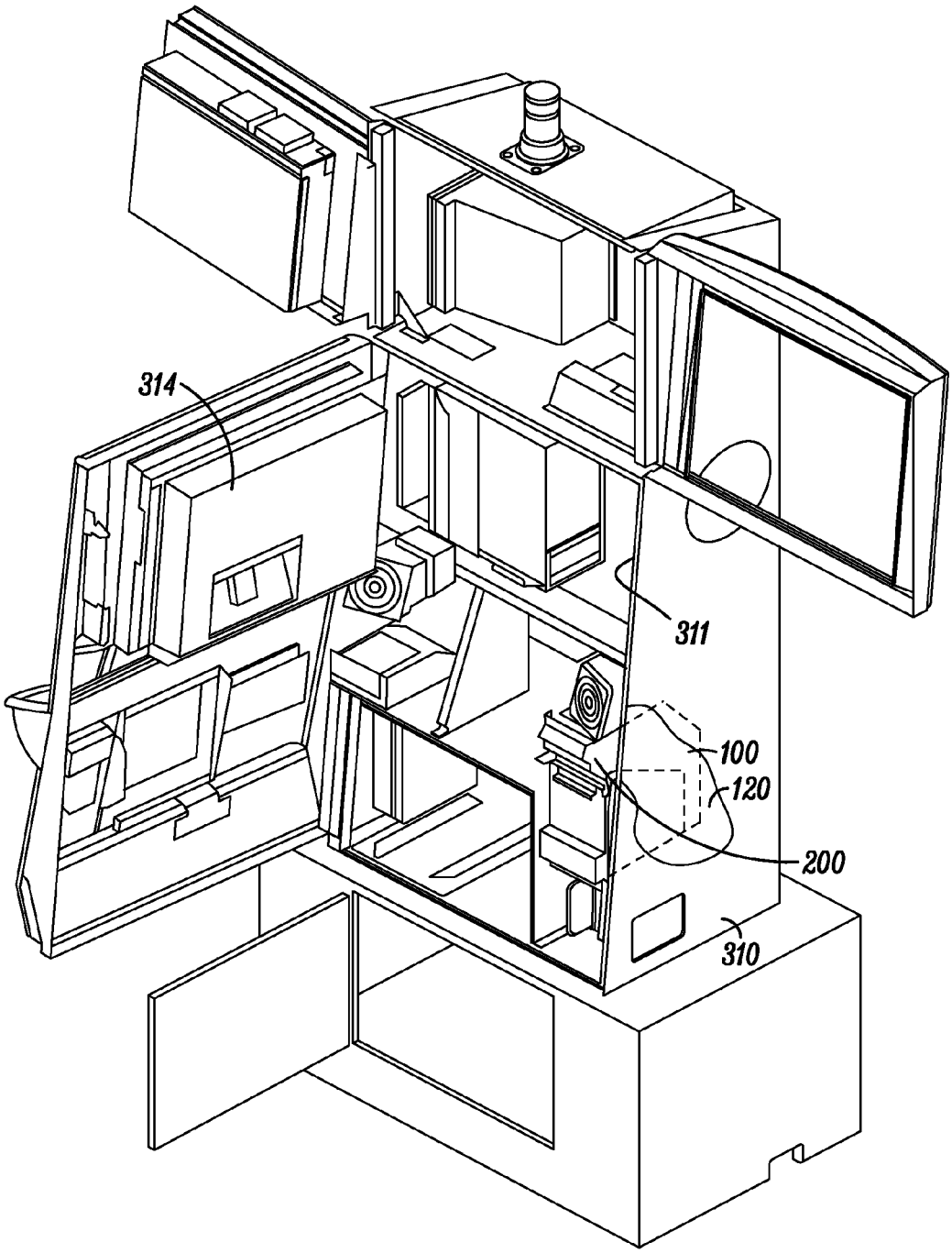
FIG. 3 is a perspective view of an upright type of gaming machine that shows a bill acceptor device including a bill validator in a substantially vertical orientation, according to an example embodiment.

FIG. 3 is a perspective view of an upright type of gaming machine 300 that shows a bill acceptor 100 that includes a bill validator 200 in a substantially vertical orientation, according to an example embodiment. The upright gaming machine 300 includes a main cabinet 310. The main cabinet 310 includes a door 312 that carries an LCD monitor 314 and a player switch panel (not shown). The player switch panel is an input/output device that the player uses to put in inputs to play a game programmed into the electronic gaming machine (EGT) 300. The touchscreen also is capable of receiving player inputs. The LCD monitor also displays aspects of the game. The cabinet 310 includes an enclosure 311. The bill acceptor 100 is positioned mainly within the enclosure 311 when the door is closed. Specifically, the slot 201 portion of the bill validator 200 is accessible when the door is closed so that a player can insert tickets or bills of various denominations into the bill validator 200 and into the bill acceptor 100. As shown in FIG. 3, the chassis 110 and the cash box 120 are attached to the inner wall of the cabinet 310 and are shown in phantom. The orientation of the cash box 120 with respect to the bill validator 200 is substantially as shown in FIGS. 1 and 2. Therefore, a downstacker type bill acceptor 110 is shown in FIG. 3. The bill validator 200 is in a substantially vertical position (see axis 254 in FIG. 2). It can also be said that the majority of the ticket or bill path 260 through the bill validator 200 is in a substantially horizontal orientation.

Figure 4:
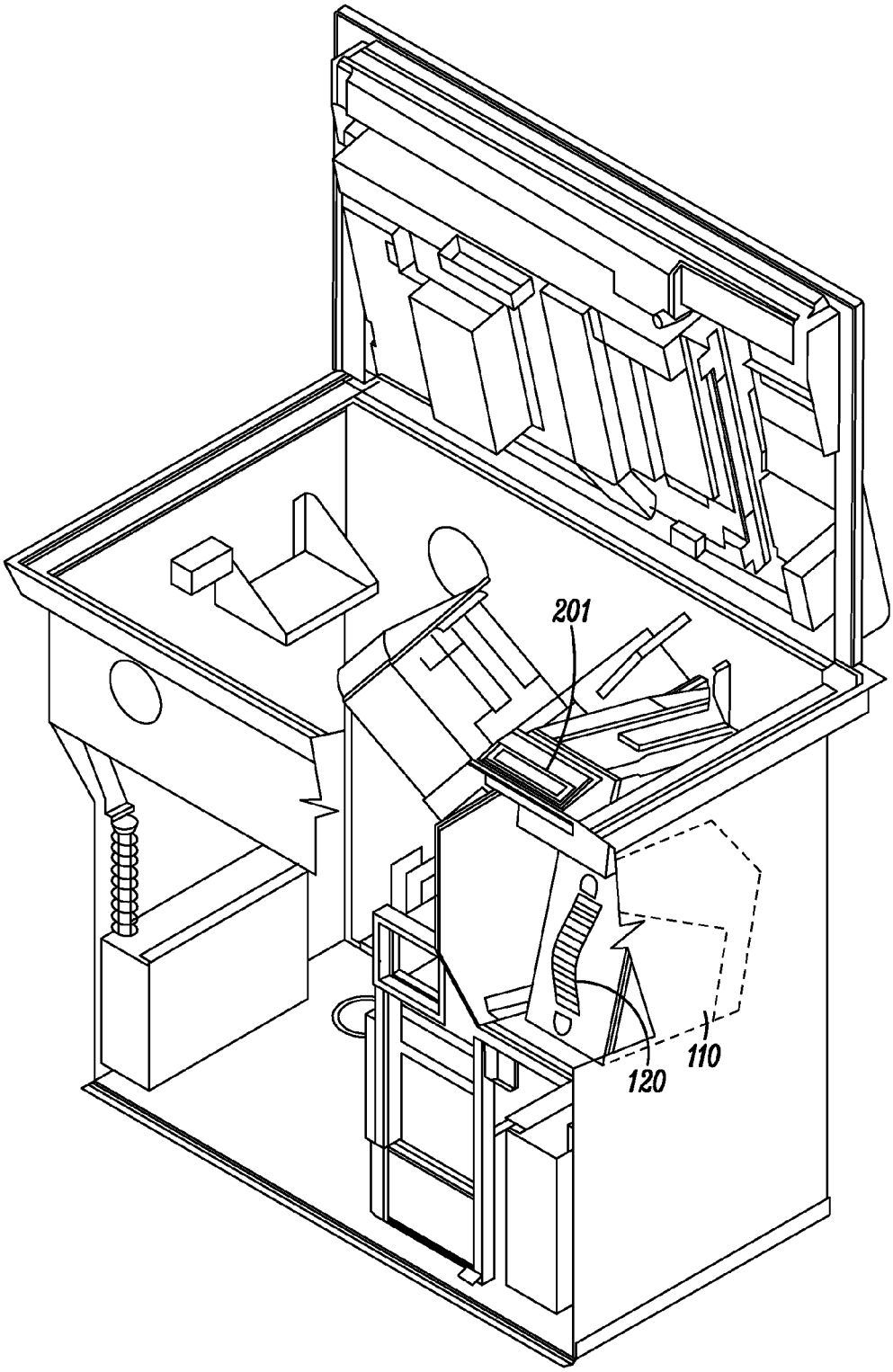
FIG. 4 is a perspective view of a bar top type of gaming machine that shows a bill acceptor device with a bill validator in a substantially vertical orientation, according to an example embodiment.
Figure 5:
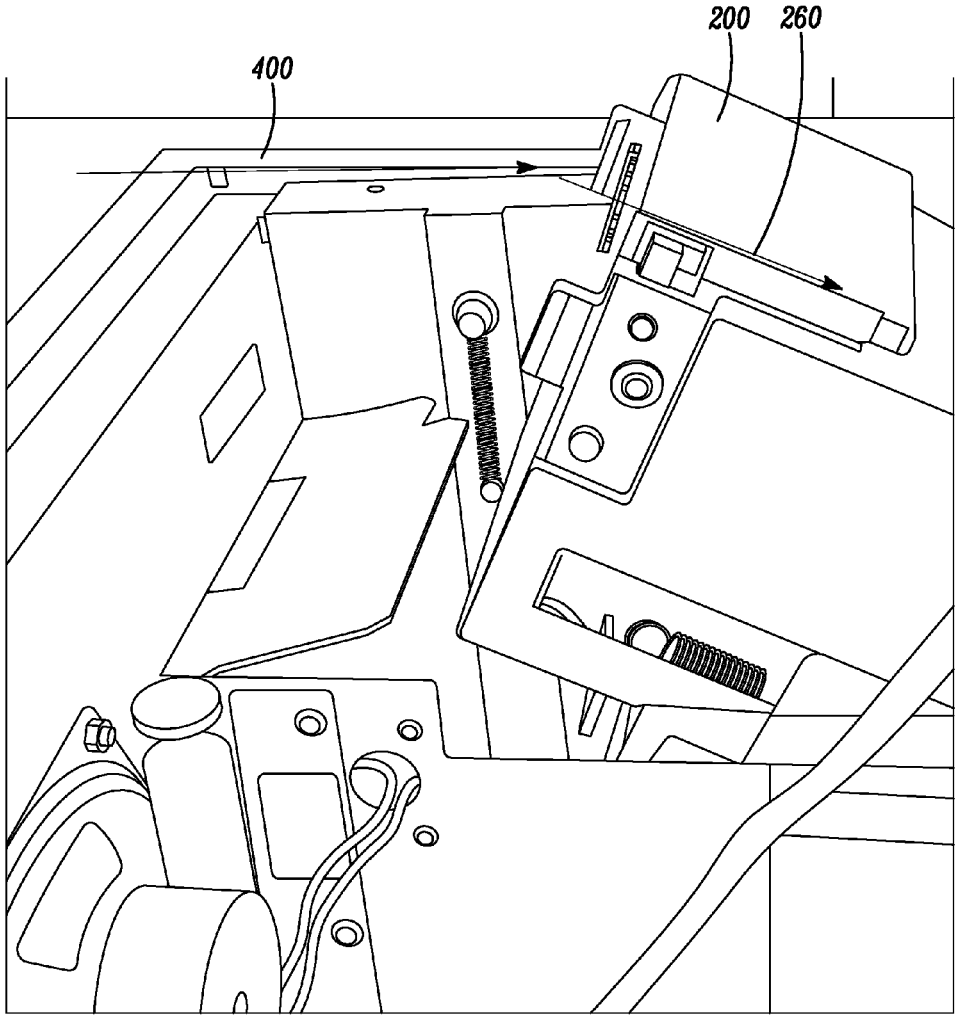
FIG. 5 is a perspective close up view of a bill validator for use as a downstacker in a bar top type electronic gaming machine, according to an example embodiment.

FIG. 4 is a perspective view of a bar top type of gaming machine 400 that also shows a bill validator 200 in a substantially vertical orientation, according to an example embodiment. FIG. 5 is a perspective view of a bar top type gaming machine 400 that shows the top portion of the bill acceptor 100 and the associated bill and ticket path 260 through the bill validator 200. Now referring to both FIGS. 4 and 5, the bill acceptor 100 and bill validator 200 as mounted in the bar top type gaming machine 400 will be further detailed. The bill acceptor 100 is mounted so that the bill validator 200 is slightly slanted with respect to a vector representing the force of gravity (vertical) to allow a substantial portion of the bill validator 200, namely the slot and a portion of the front face, of the bill acceptor 100 to be accessible at the bar top surface when the door is closed. The slanted or slightly off vertical mount (with respect to axis 254 of FIG. 2) allows the bill acceptor 100 to fit within a cabinet 410 of the EGM 400 while still allowing a player to access the slot 201 to insert bills and tickets as necessary. FIG. 5 is a closeup perspective view of the bill acceptor 100 and the bill validator 200 and shows a currency and ticket path 260 through the bill validator 200. FIG. 5 also more accurately shows the amount of slant from vertical, with respect to axis 254 (shown in FIG. 2). The slot 201 and front face of the bill validator 200 are also somewhat slanted so as to shed liquids, should a user spill a beverage during play. The slot 201 and the bill validator 200 as well as the ticket and bill path 260 are also somewhat slanted with respect to vertical. When in this orientation, the bill validator 200 is still in a position where one of the sensors or readers 250, 252 will be higher than the other. The orientation detection device 210 detects the orientation, such as by determining the direction of the vector associated with the force of gravity. The appropriate sensor or reader 250, 252 is enabled. Again, the bill acceptor 100 is still close to vertical and close to the orientation shown in FIG. 2. Provided that the desired ticket position is with the information desired being "up" when inserted in the slot, the sensor 250 will be enabled for reading and validating tickets or bills inserted into the slot 201.

Figure 6:
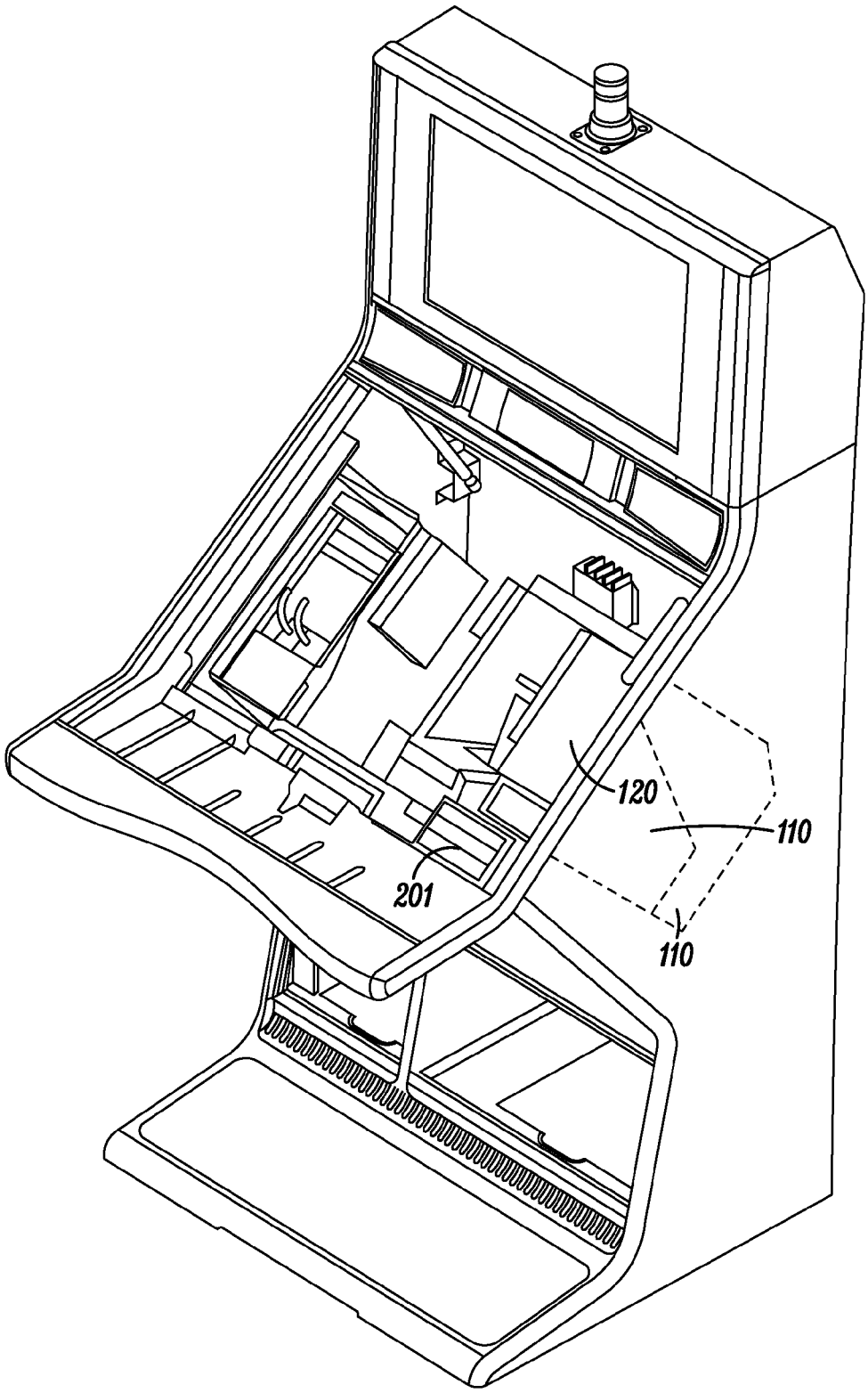
FIG. 6 is a schematic view of a bill acceptor device with a bill validator for use as an upstacker in a slant top electronic gaming machine, according to an example embodiment.

FIG. 6 is a perspective view of a slant top type gaming machine 600 that shows the bill acceptor 700 and bill validator 200 in an alternate orientation, according to an example embodiment. The cash box 120 is placed above the bill validator 200 in this alternate orientation. The chassis 110 of the bill acceptor 100 still holds the bill validator 200 and the cashbox 120. The bill acceptor 100 is constructed in substantially the same way; however, it is orientated differently, as shown by FIG. 6. The bill acceptor is considered an "upstacker" when orientated in the manner shown in FIG. 6. Of course, the bill acceptor 700 is mounted within the cabinet of the slant top EGM 600. For the sake of simplicity, the door or top cover of the slant top EGM 600 is removed and is closed to form a secure cabinet for the cash box 120 and the computer portions, electrical gear, and lights which operate during game play.

Figure 7:
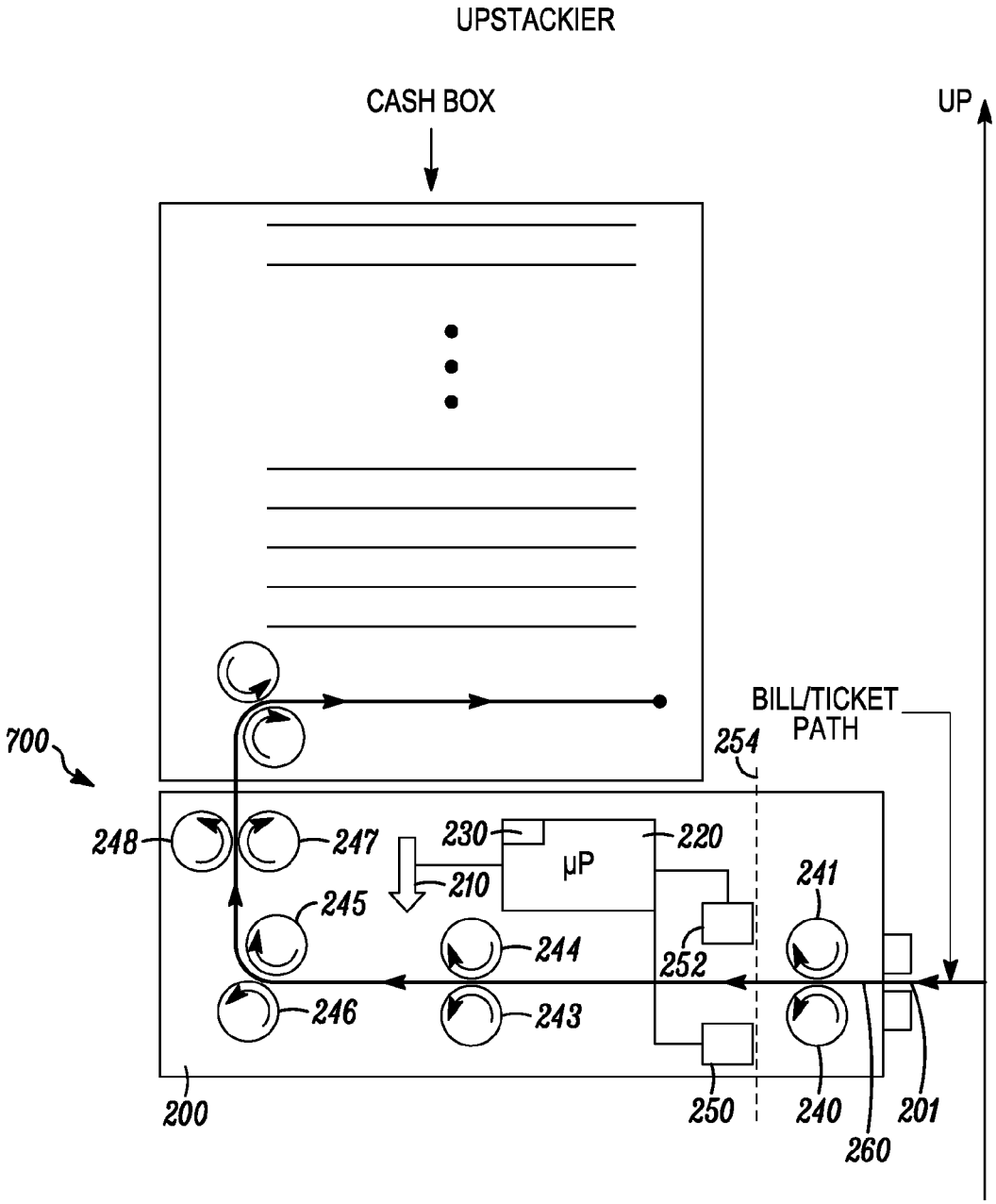
FIG. 7 is a schematic view of a bill acceptor device with a bill validator for use as an upstacker in a slant top gaming machine, according to an example embodiment.

FIG. 7 shows a schematic diagram of a bill acceptor 700, according to an example embodiment. The bill acceptor 700 shown in FIG. 2 is an upstacker type bill acceptor 700. The bill validator 200 includes the orientation detection device 210 as well as a microprocessor 220 and memory 230. The bill validator 200 also includes a transport mechanism 240 and a first sensor 250 and a second sensor 252. The first sensor 250 and the second sensor 252 are communicatively coupled to the microprocessor 220 and the associated memory 230. Of course, the memory 230 can be random access memory ("RAM"), or another type of memory or a combination of RAM and another type of memory. The sensors 250 and 252 actually do the reading and sensing to validate a bill or ticket. An axis 254, depicted by a dashed line, for the bill validator 200 passes through or along side the first sensor 250 and the second sensor 252.

The transport mechanism 240 can include one or more rollers adapted to move an item past the sensors 250 and 252 where the item being transported is either validated and transported to the cash box 120, or rejected and backed out of the bill validator 200 through a slot 201 at a front face 202 of the bill validator 200. The bill validator 200 includes a bill or ticket path 260 along which a bill or ticket is transported through the bill validator 200 and to the cash box. In some environments, the bill validator 200 not only reads information to validate that the item being transported is cash currency, but also validates information printed on a ticket. A ticket or paper currency is placed in the slot 201, and transported along the currency or ticket path 260 by means of rollers 241, 242, 243, 244, 245, 246, 247, 248 associated with the transport mechanism 240. It should be noted that the bill transport mechanism 240 not only includes the ability to move currency or a ticket in the direction of the bill or ticket path 260 (as depicted by the arrows in FIG. 7), but also in a reverse direction if a bill or ticket is rejected, and transverse to the bill or ticket path 260 in the event a bill or ticket needs repositioning. The transport mechanism 240 transports the bill or ticket to be validated past a first sensor or reader 250, and past a second sensor or reader 252. One of the sensors or readers 250, 252 is enabled to read the items transported along the bill or ticket path 260. In some embodiments, a sensor 250, 252 can read and validate a bill regardless of which side of the bill is facing the sensor 250, 252. Tickets, however, generally are printed only on one side or only carry the needed information on one side of the ticket. To validate and read a ticket or the information on the ticket, the side with the information to be read must be presented to one of the sensors 250, 252. Tickets are generally printed to paper stock that cannot be read from a side other than the side on which the information needed is printed. As a result, at least the tickets must be placed on the paper path in a proper orientation so that the tickets can be read.

The orientation detection device 210 determines the orientation of the bill validator 200. In one embodiment, the ticket orientation is with the printed information "up". In some embodiments, the ticket must also be orientated as positioned at or near the side of the paper path 260 or at the side of the slot 201. In these embodiments, the ticket items must be placed in the slot either "up and to the right edge" or "up and to the left edge". The orientation detection device 210 determines which way is up. Put another way, the orientation detection device 210 determines which of the sensors or readers 250, 252 is above the other of the sensors or readers 252, 250 in the current orientation. The sensor or reader 250 or 252, that is above a bill or ticket transport path 260 is enabled. Again, put another way, the sensor or reader 250 or 252 that is highest is enabled, while the other sensor or reader 252 or 250 is disabled or not enabled. The orientation detection device 210, in one embodiment, is an accelerometer that detects the force of gravity. Once the vector associated with the force of gravity is determined, the up position or orientation can be determined. Up will be opposite the force of gravity. The position of the sensors or readers 250, 252 relative to one another can also be determined once the direction of gravity is determined. In another embodiment, an electromechanical orientation detection device can be used. In this embodiment, an elongated member that is electrically conductive is placed on a pivot. Two additional pins bracket the free end of the elongated member. If the bill validator 200 is positioned one way (with sensor 250 above sensor 252), the elongated member will contact one pin, and if the bill validator 200 is positioned another way (with sensor 252 above sensor 250), the elongated member will contact the other pin. Based on the determined orientation, one of the sensors 250 or 252 will be enabled. For example, if orientated as shown in FIG. 2, the sensor 250 will be enabled if the required orientation for the tickets is "up". In another embodiment, the ticket's proper orientation could be with the printing "down" and then the sensor 252 would be enabled.

Tickets or bills placed on the bill or ticket path 260 are tested for validation by the enabled sensor, such as sensor 250 in FIG. 7, when the ticket is placed onto the bill or ticket path 260 with the printing or required information facing up at the slot 201. Validation takes place if the ticket or bill is valid. If valid, the transport mechanism 240 moves the ticket or bill to the cash box 120. As shown in FIG. 7, a bill 121, a ticket 122, and a bill 123 and other bills and tickets are positioned in the cash box 120. This particular orientation of the bill acceptor 700 is referred to as an upstacker type bill acceptor. As shown in FIG. 7, the sensor 252 is enabled.

The orientation determination device 210 within or externally mounted to or near a bill validator 200 is used to determine the orientation of the bill validator 200. The orientation determination device 210 of the bill validator 200 automatically and dynamically determines orientation by sensing gravity and produces a signal to the microprocessor 220 in the host device or bill validator 200. In response to the signal, the bill validator 200 sets up various options within itself without user interaction.

One of the options includes enabling the sensor or reader 250, 252 of the bill validator 200 that is above the other or most opposite the force of gravity. As shown in FIG. 2, the sensor or reader 250 is enabled and the bill validator is considered a "downstacker" type of bill acceptor. Substantially the same hardware can be mounted in a different orientation, as depicted by FIG. 7, and the orientation determination device 210 senses gravity and enables the other reader or sensor 252. In this orientation, the bill acceptor and bill validator are considered as an "upstacker". Depending on whether the bill acceptor 200, 700 is designated an "upstacker" (sensor 252 higher and enabled) or a "downstacker" (sensor 250 higher and enabled), the ticket acceptance options are also set accordingly. For example, tickets are usually only accepted two ways (face up and right/face up and left), so the orientation detecting device 210, which can also be termed a gravity sensing device, is used to automatically determine what way is up and use the proper set of sensors accordingly so that the bill validator only accepts tickets face up. Of course, in another embodiment, the settings and sensors could be set to receive and accept tickets in a face down orientation.

Figure 8:
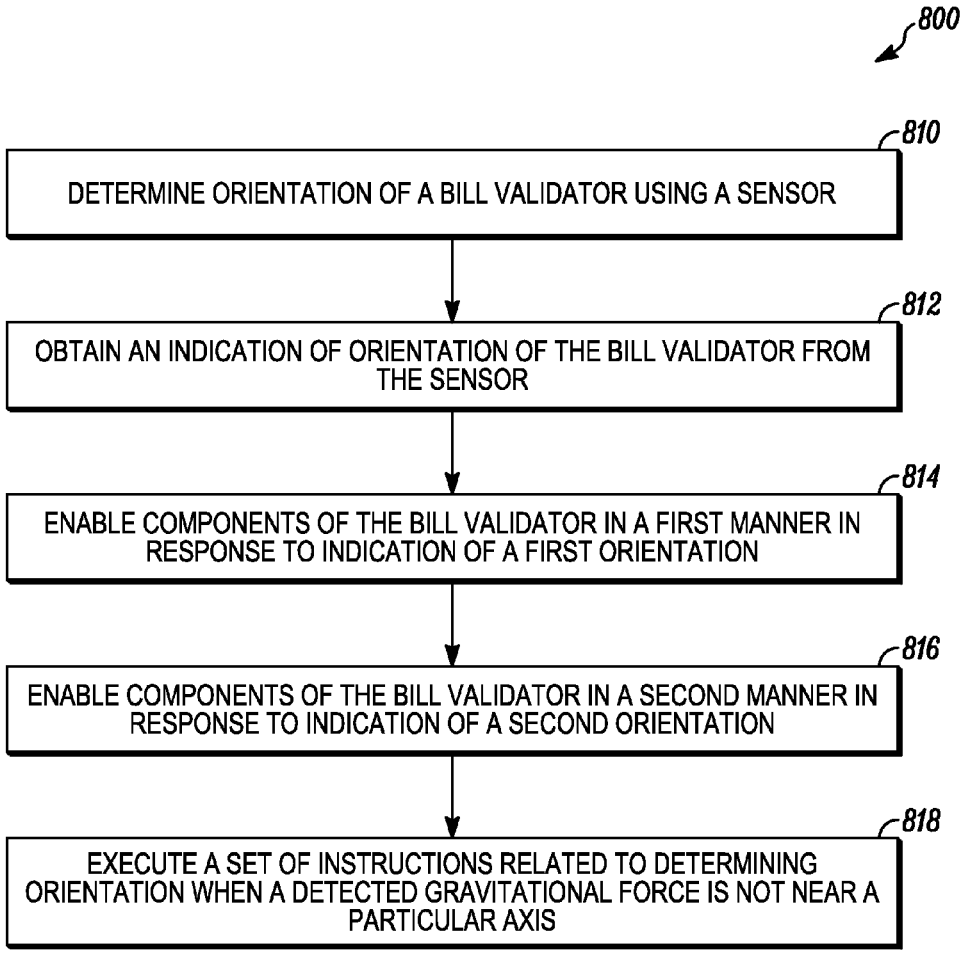
FIG. 8 is a flow diagram of a method for operating a bill validator, according to an example embodiment.

FIG. 8 is a method 800 for operating a bill validator, according to an example embodiment. The method 800 for operating a bill validator includes determining orientation of a bill validator using a sensor 810, obtaining an indication of orientation of the bill validator from the sensor 812, and enabling components of the bill validator in a first manner in response to indication of a first orientation 814, and enabling components of the bill validator in a second manner in response to indication of a second orientation 816. Determining orientation includes the sensor producing a first signal for the first orientation and producing a second signal for the second orientation. In another embodiment, determining orientation 810 includes the sensor producing a first signal for the first orientation and producing no signal for the second orientation. Determining orientation 910 includes sensing gravity either mechanically or using an accelerometer. The components of bill validator are enabled in a first manner in response to indication of a first orientation; and are enabled in a second manner in response to indication of a second orientation. The same component can be enabled in different manners for different orientations. In another embodiment, enabling components of the bill validator in a first manner 814 in response to indication of a first orientation includes enabling a first set of components of the bill validator, and enabling the components of the bill validator in a second manner 816 in response to indication of a second orientation, includes enabling a second set of components. The method 800 also includes executing a set of instructions related to determining orientation when a detected gravitational force is not near a particular axis 818. The set of instructions includes a set of rules with respect to angular displacement of a gravitational force from an axis of the bill validator.

Figure 9:
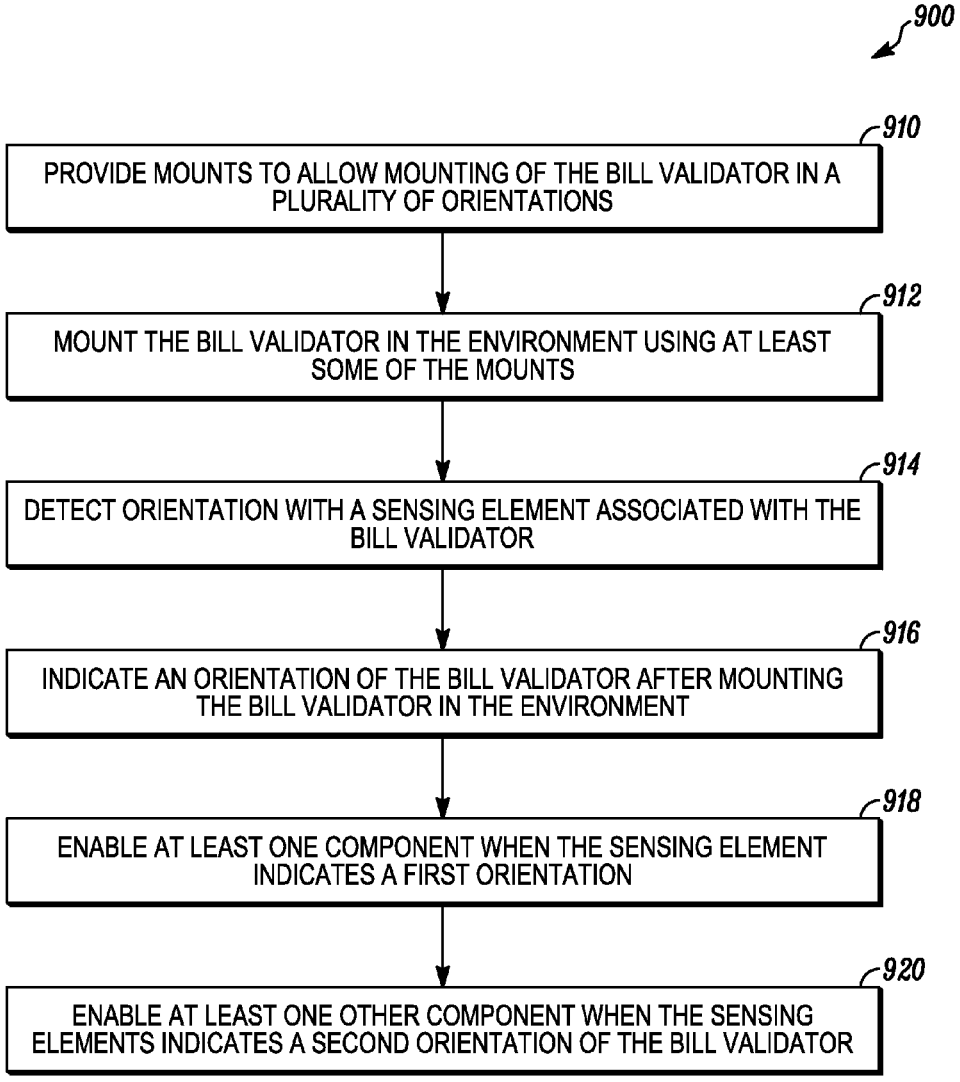
FIG. 9 is a flow diagram of a method 900 for placing or replacing a bill validator, according to an example embodiment.

FIG. 9 is a flow diagram of a method 900 for placing or replacing a bill validator, according to an example embodiment. The method 900 for placing a bill validator apparatus in an environment includes providing mounts to allow mounting of the bill validator in a plurality of orientations 910, and mounting the bill validator in the environment using at least some of the mounts 912. The method 900 also includes detecting orientation with a sensing element associated with the bill validator 914, indicating an orientation of the bill validator after mounting the bill validator in the environment 916, enabling at least one component when the orientation determination device indicates a first orientation 918, and enabling at least one other component when the orientation determination device indicates a second orientation of the bill validator 920. In another embodiment, enabling at least one component 918 includes enabling a plurality of subcomponents of the component. Enabling at least one other component 920 includes enabling a plurality of subcomponents of a different component. Detecting orientation with a sensing element 914 associated with the bill validator includes the sensor producing a first signal for the first orientation and producing a second signal for the second orientation. Detecting orientation with a sensing element 914 associated with the bill validator includes the sensor producing a first signal for the first orientation and producing no signal for the second orientation. Detecting orientation also includes sensing gravity. The sensor includes an accelerometer for sensing the force of gravity. Detecting orientation can also include mechanically detecting orientation. Detecting orientation 914 includes executing a set of instructions related to detecting orientation when a detected gravitational force is not near a particular axis. The set of instructions includes a set of rules with respect to angular displacement of a gravitational force from an axis of the bill validator.

As mentioned above, the gravity sensor allows a single bill validator to be used either as an "upstacker" or a "downstacker". As a result, there could be a situation where a bill validator is taken out of one EGM and installed into another EGM before the cash box is emptied. The orientation could also be changed from an "upstacker" to a "downstacker" or vice versa during such a switch. In one embodiment, the bill validator has the capacity to verify that the cashbox has been emptied before allowing an acceptance sensor to be switched. This prevents a situation where a bill validator is taken from a "downstacker" orientation and installed in an "upstacker" orientation with bills and tickets already in the cashbox. In such a situation, the orientation of the bills and tickets would be wrong for any that are added after the bill validator has been installed in the upstacker orientation. The bill validator would be provided with hardware or software that would sense the change in bill validator orientation and would also require a signal that the cashbox had been emptied before enabling the acceptance of additional bills and tickets.

Figure 10:
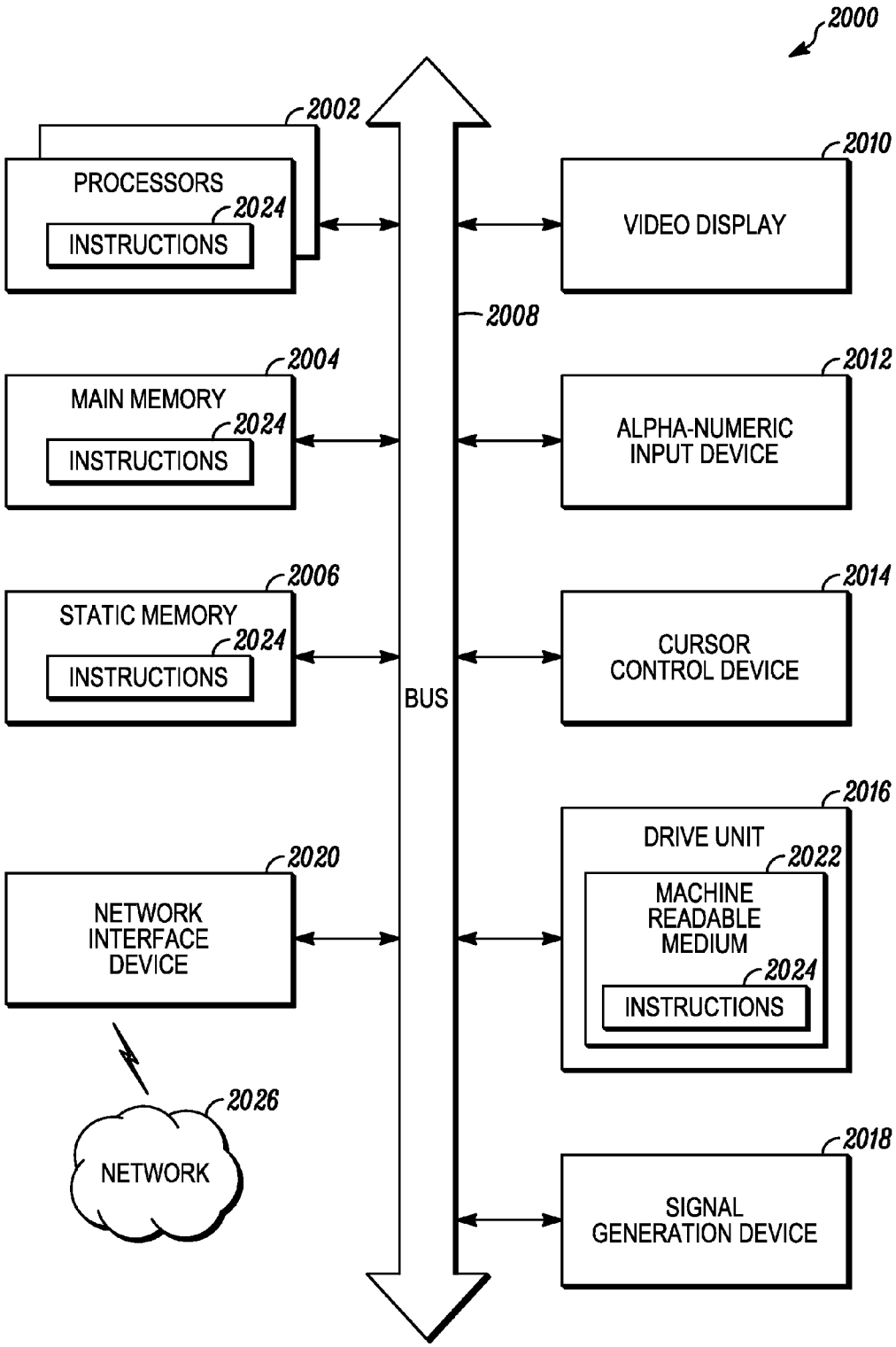
FIG. 10 shows a schematic diagram of a computer system used in the gaming system, according to an example embodiment.

FIG. 10 shows a diagrammatic representation of a computing device for a machine in the example electronic form of a computer system 2000, within which a set of instructions for causing the machine to perform any one or more of the methods 800, 900 or operations discussed herein and which can be executed or is adapted to include the apparatus for making various settings as described herein. In various example embodiments, the machine operates as a standalone device or can be connected (e.g., networked) to other machines. In one embodiment, the computer system is a microprocessor 220 and memory 230 of an electronic machine (shown in FIGS. 2 and 7 and discussed above). In a networked deployment, the machine can operate in the capacity of a server or a client machine in a server-client network environment, or as a peer machine in a peer-to-peer (or distributed) network environment. The machine can be a personal computer (PC), a tablet PC, a set-top box (STB), a Personal Digital Assistant (PDA), a cellular telephone, a portable music player (e.g., a portable hard drive audio device such as an Moving Picture Experts Group Audio Layer 3 (MP3) player, a web appliance, a network router, a switch, a bridge, or any machine capable of executing a set of instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein.

The example computer system 2000 includes a processor or multiple processors 2002 (e.g., a central processing unit (CPU), a graphics processing unit (GPU), arithmetic logic unit or all), and a main memory 2004 and a static memory 2006, which communicate with each other via a bus 2008. The computer system 2000 can further include a video display unit 2010 (e.g., a liquid crystal displays (LCD) or a cathode ray tube (CRT)). The computer system 2000 also includes an alphanumeric input device 2012 (e.g., a keyboard), a cursor control device 2014 (e.g., a mouse), a disk drive unit 2016, a signal generation device 2018 (e.g., a speaker) and a network interface device 2020.

The disk drive unit 2016 includes a computer-readable medium 2022 on which is stored one or more sets of instructions and data structures (e.g., instructions 2024) embodying or utilized by any one or more of the methodologies or functions described herein. The instructions 2024 can also reside, completely or at least partially, within the main memory 2004 and/or within the processors 2002 during execution thereof by the computer system 2000. The main memory 2004 and the processors 2002 also constitute machine-readable media.

The instructions 2024 can further be transmitted or received over a network 2026 via the network interface device 2020 utilizing any one of a number of well-known transfer protocols (e.g., Hyper Text Transfer Protocol (HTTP), CAN, Serial, or Modbus).

While the computer-readable medium 2022 is shown in an example embodiment to be a single medium, the term "computer-readable medium" should be taken to include a single medium or multiple media (e.g., a centralized or distributed database, and/or associated caches and servers) that store the one or more sets of instructions and provide the instructions in a computer readable form. The term "computer-readable medium" shall also be taken to include any medium that is capable of storing, encoding, or carrying a set of instructions for execution by the machine and that causes the machine to perform any one or more of the methodologies of the present application, or that is capable of storing, encoding, or carrying data structures utilized by or associated with such a set of instructions. The term "computer-readable medium" shall accordingly be taken to include, but not be limited to, solid-state memories, optical and magnetic media, tangible forms and signals that can be read or sensed by a computer. Such media can also include, without limitation, hard disks, floppy disks, flash memory cards, digital video disks, random access memory (RAMs), read only memory (ROMs), and the like.

The example embodiments described herein can be implemented in an operating environment comprising computer-executable instructions (e.g., software) installed on a computer, in hardware, or in a combination of software and hardware. Modules as used herein can be hardware or hardware including circuitry to execute instructions. The computer-executable instructions can be written in a computer programming language or can be embodied in firmware logic. If written in a programming language conforming to a recognized standard, such instructions can be executed on a variety of hardware platforms and for interfaces to a variety of operating systems. Although not limited thereto, computer software programs for implementing the present method(s) can be written in any number of suitable programming languages such as, for example, Hyper text Markup Language (HTML), Dynamic HTML, Extensible Markup Language (XML), Extensible Stylesheet Language (XSL), Document Style Semantics and Specification Language (DSSSL), Cascading Style Sheets (CSS), Synchronized Multimedia Integration Language (SMIL), Wireless Markup Language (WML), Java™, Jini™, C, C++, Perl, UNIX Shell, Visual Basic or Visual Basic Script, Virtual Reality Markup Language (VRML), ColdFusion™ or other compilers, assemblers, interpreters or other computer languages or platforms.

A bill validating apparatus includes a housing. The housing has an elongated opening 260 therein. In one embodiment, the elongated opening also serves as a path for items, such as currency or tickets, to travel or pass. At one end of the elongated slot there is an article receiving slot 201. A first sensor 250 is on one long side of the elongated opening 260. A second sensor 252 is on the other long side of the elongated opening 260. The bill validating system 200 includes a transport mechanism 400 for moving the article of tender past a first sensor 250 and a second sensor 252. The bill validating apparatus 200 also includes an orientation determination device 210. The orientation determination device 210 is communicatively coupled to the first sensor 250 and the second sensor 252. The orientation determination device 210 enables one of the first sensor 250 or the second sensor 252 based on the determined orientation of the bill validating apparatus 200. The orientation determination device 210 includes an accelerometer. In another embodiment, the orientation determination device 210 includes a first electrically conductive member 1110, a second electrically conductive member 1112, and a third electrically conductive member 1114. The first electrically conductive member 1110 is pivotally mounted on one end. The free end 1111 of the first electrically conductive member 1110 is positioned between the first 1112 and second electrically conductive member 1114 when the bill validating apparatus 200 is in a first orientation, and positioned in an electrically conductive position when in a second orientation. The orientation determination device 210 can be placed on an external surface of the housing or within the housing. The orientation determination device 210, in one embodiment, is communicatively coupled to a processor 220 associated with the bill validator. The processor 220 sets up components within the bill validator 200 in response to the determined orientation. For one orientation the settings on a component will be set to a first value and for another component the settings on a component will be set to a second value. In some bill validators 200, duplicate components are provided. For one determined orientation, one of the duplicate components is selected, and for the another orientation the other of the duplicate components are selected. In the bill validating apparatus, values related to orientation are settable. The bill validating apparatus 200 is mounted within a machine and capable of validating a ticket having printing on one side of the ticket when the ticket is presented to the bill validator. The enabled first sensor 260 of the bill validator 200 is used to sense the printed side of the ticket when the bill validator is in a first orientation. The enabled second sensor 252 of the bill validator is used to sense the printed side of the ticket when the bill validator 200 is in a second orientation. A bill validating apparatus includes a housing. The housing has an elongated opening therein. At one end of the elongated slot there is an article receiving slot. A first sensor 250 is on one long side of the elongated slot. A second sensor 252 is on the other long side of the elongated slot. The bill validating system 200 includes a transport mechanism 400 for moving the article of tender past a first sensor 250 and a second sensor 252. The bill validating apparatus 200 also includes an orientation determination device 210. The orientation determination device 210 is communicatively coupled to the first sensor 250 and the second sensor 252. The orientation determination device 210 enables one of the first sensor 250 or the second sensor 252 based on the determined orientation of the bill validating apparatus 200. The orientation determination device 210 includes an accelerometer. In another embodiment, the orientation determination device 210 includes a first electrically conductive member 1112, a second electrically conductive member 1114, and a third electrically conductive member 1110. The third electrically conductive member 1110 is pivotally mounted on one end. The free end 1111 of the third electrically conductive member 1110 is positioned between the first 1112 and second electrically conductive member 1114 when the bill validating apparatus is in a first orientation, and positioned in an electrically conductive position when in a second orientation. The orientation determination device can be placed on an external surface of the housing or within the housing. The orientation determination device 210, in one embodiment, is communicatively coupled to a processor 220 associated with the bill validator 200. The processor 220 sets up components within the bill validator 200 in response to the determined orientation. For one orientation the settings on a component will be set to a first value and for another component the settings on a component will be set to a second value. In some bill validators 200, duplicate components are provided. For one determined orientation, one of the duplicate components is selected, and for the another orientation the other of the duplicate components are selected. In the bill validating apparatus, values related to orientation are settable. The bill validating apparatus is mounted within a machine and capable of validating a ticket having printing on one side of the ticket when the ticket is presented to the bill validator 200. The enabled first sensor 250 of the bill validator is used to sense the printed side of the ticket when the bill validator 200 is in a first orientation. The enabled second sensor 252 of the bill validator 200 is used to sense the printed side of the ticket when the bill validator is in a second orientation.

The bill validator 200 that works as either an "upstacker" or a "downstacker", known as a universal stacker, with the orientation determination device 210 allows a technician to merely mount the bill acceptor or a new bill validator into a machine without having to set the bill validator as either an "upstacker" or a "downstacker" and without having to make settings regarding the orientation. Setting the bill validator 210 would be automatic based on the orientation. Manufacturers and maintenance entities can reduce the number of stocked bill validator assemblies they need to carry. In essence, the number of stocked bill validators could easily be cut in half as there is no need to carry both an "upstacker" and a "downstacker" type assembly. Furthermore, field problems and paperwork associated with tracking DIP switch settings are reduced or eliminated. Field conversions of various machines would be eased since only one universal bill validator 200 could be used. The technician's job would be simplified since only one bill validator goes in all machines, and orientation no longer matters. There would be no options to set. The bill validator could be merely swapped out.

The foregoing description, for purposes of explanation, used specific nomenclature to provide a thorough understanding of the invention. However, it will be apparent to one skilled in the art that the specific details are not required in order to practice the invention. Thus, the foregoing descriptions of specific embodiments of the present invention are presented for purposes of illustration and description. They are not intended to be exhaustive or to limit the invention to the precise forms disclosed. It will be apparent to one of ordinary skill in the art that many modifications and variations are possible in view of the above teachings.

The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

While the embodiments have been described in terms of several particular embodiments, there are alterations, permutations, and equivalents, which fall within the scope of these general concepts. It should also be noted that there are many alternative ways of implementing the methods and apparatuses of the present embodiments. It is therefore intended that the following appended claims be interpreted as including all such alterations, permutations, and equivalents as fall within the true spirit and scope of the described embodiments.

What is claimed:

1. A bill validating apparatus comprising:

a housing;

an elongated opening within the housing having an article receiving slot at one end of the elongated opening, the article receiving slot sized to receive articles of tender;

a first sensor on one long side of the elongated slot;

a second sensor on the other long side of the elongated slot;

a transport mechanism for moving the article of tender past a first sensor and a second sensor; and an orientation determination device communicatively coupled to the first sensors and the second sensors the orientation determination device enabling one of the first sensor or the second sensor based on the determined orientation of the bill validating apparatus.

2. The bill validating apparatus of claim 1 wherein the orientation determination device includes an accelerometer.

3. A bill validating apparatus comprising:

a housing;

an elongated opening within the housing having an article receiving slot at one end of the elongated opening, the article receiving slot sized to receive articles of tender;

a first sensor on one long side of the elongated slot;

a second sensor on the other long side of the elongated slot;

a transport mechanism for moving the article of tender past a first sensor and a second sensor; and an orientation determination device communicatively coupled to the first sensors and the second sensors the orientation determination device enabling one of the first sensor or the second sensor based on the determined orientation of the bill validating apparatus, wherein the orientation determination device further comprises:

a first electrically conductive member;

a second electrically conductive member; and a third electrically conductive member which is pivotally mounted on one end, the third electrically conductive member positioned between the first and second electrically conductive member when the bill validating apparatus is in a first orientation and positioned in an electrically conductive position when in a second orientation.

4. The bill validating apparatus of claim 1 wherein the orientation determination device is placed on an external surface of the housing.

5. The bill validating apparatus of claim 1 wherein the orientation determination device is positioned within the housing.

6. The bill validating apparatus of claim 1 wherein the orientation determination device is communicatively coupled to a processor associated with the bill validator, the processor controllably setting components within the bill validator that depend on the determined orientation.

7. The bill validating apparatus of claim 6 wherein values related to orientation are settable.

8. The bill validating apparatus of claim 6 wherein the bill validating device includes:

a first set of components; and a second set of components, the first set of components substantially duplicative of the second set of components, one of the first set of components, and the second set of components enabled when the bill validating apparatus is in a first orientation and wherein the other of the first set of components, and the second set of duplicate components is enabled when the bill validating apparatus is in a second orientation.

9. The bill validating apparatus of claim 1 mounted within a machine and capable of validating a ticket having printing on one side of the ticket when the ticket is presented to the bill validator.

10. A bill validating apparatus mounted within a machine and capable of validating a ticket having printing on one side of the ticket when the ticket is presented to the bill validator, the bill validating apparatus comprising:

a housing;

an elongated opening within the housing having an article receiving slot at one end of the elongated opening, the article receiving slot sized to receive articles of tender;

a first sensor on one long side of the elongated slot;

a second sensor on the other long side of the elongated slot;

a transport mechanism for moving the article of tender past a first sensor and a second sensor; and an orientation determination device communicatively coupled to the first sensors and the second sensors the orientation determination device enabling one of the first sensor or the second sensor based on the determined orientation of the bill validating apparatus, wherein the enabled first sensor of the bill validator is used to sense the printed side of the ticket when the bill validator is in a first orientation.

11. A bill validating apparatus mounted within a machine and capable of validating a ticket having printing on one side of the ticket when the ticket is presented to the bill validator, the bill validating apparatus comprising:

a housing;

an elongated opening within the housing having an article receiving slot at one end of the elongated opening, the article receiving slot sized to receive articles of tender;

a first sensor on one long side of the elongated slot;

a second sensor on the other long side of the elongated slot;

a transport mechanism for moving the article of tender past a first sensor and a second sensor; and an orientation determination device communicatively coupled to the first sensors and the second sensors the orientation determination device enabling one of the first sensor or the second sensor based on the determined orientation of the bill validating apparatus, wherein the enabled second sensor of the bill validator is used to sense the printed side of the ticket when the bill validator is in a second orientation.

12. A method for operating a bill validator comprising:

determining orientation of a bill validator using a sensor;

obtaining an indication of orientation of the bill validator from the sensor;

enabling a first set of components of the bill validator in a first manner in response to indication of a first orientation; and enabling a second set of components of the bill validator in a second manner in response to indication of a second orientation.

13. The method of claim 12 wherein the determining orientation of the bill validator includes the sensor producing a first signal for the first orientation and producing a second signal for the second orientation.

14. The method of claim 12 wherein the determining orientation of the bill validator includes the sensor producing a first signal for the first orientation and producing no signal for the second orientation.

15. The method of claim 12 wherein the determining orientation of the bill validator includes sensing gravity.

16. The method of claim 12 wherein the sensor includes an accelerometer for sensing the force of gravity.

17. The method of claim 12 wherein determining orientation includes a mechanically determining orientation.

18. The method of claim 12 wherein enabling components of the bill validator in a first manner in response to indication of a first orientation, and enabling components of the bill validator in a second manner in response to indication of a second orientation, includes enabling the same components in different manners.

19. The method of claim 12 wherein enabling components of the bill validator in a first manner in response to indication of a first orientation includes enabling a first set of components of the bill validator and wherein enabling the components of the bill validator in a second manner in response to indication of a second orientation, includes enabling a second set components.

20. The method of claim 12 further comprising executing a set of instructions related to determining orientation when a detected gravitational force is not near a particular axis.

21. The method of claim 20 wherein the set of instructions includes a set of rules with respect to angular displacement of a gravitational force from an axis of the bill validator.

22. A method for placing a bill validator apparatus in an environment comprising:

providing mounts to allow mounting of the bill validator in a plurality of orientations;

mounting the bill validator in the environment using at least some of the mounts;

detecting orientation with a sensing element associated with the bill validator;

indicating an orientation of the bill validator after mounting the bill validator in the environment;

enabling at least one component when the sensing element indicates a first orientation; and enabling at least one other component when the orientation determination device indicates a second orientation of the bill validator.

23. The method of claim 22 wherein enabling at least one component includes enabling a first plurality of subcomponents of the component.

24. The method of claim 22 wherein enabling at least one other component includes enabling a second plurality of subcomponents of the at least one other component.

25. The method of claim 22 wherein detecting orientation with a sensing element associated with the bill validator includes the sensor producing a first signal for the first orientation and producing a second signal for the second orientation.

26. The method of claim 22 wherein detecting orientation with a sensing element associated with the bill validator includes the sensor producing a first signal for the first orientation and producing no signal for the second orientation.

27. The method of claim 22 wherein detecting orientation includes sensing gravity.

28. The method of claim 22 wherein the sensor includes an accelerometer for sensing the force of gravity.

29. The method of claim 22 wherein detecting orientation includes mechanically detecting orientation.

30. The method of claim 22 wherein detecting orientation includes executing a set of instructions related to detecting orientation when a detected gravitational force is not near a particular axis.

31. The method of claim 30 wherein the set of instructions includes a set of rules with respect to angular displacement of a gravitational force from an axis of the bill validator.

* * * * *